US007125302B2

(12) United States Patent
Haselsteiner

(10) Patent No.: US 7,125,302 B2
(45) Date of Patent: Oct. 24, 2006

(54) PERSONAL FLOTATION DEVICE AND METHOD FOR SAME

(75) Inventor: Hubert Haselsteiner, 1701 143rd St. W., Burnsville, MN (US) 55306

(73) Assignee: Hubert Haselsteiner, Burnsville, MN (US)

( * ) Notice: Subject to any disclaimer, the term of this patent is extended or adjusted under 35 U.S.C. 154(b) by 0 days.

(21) Appl. No.: 11/158,901

(22) Filed: Jun. 22, 2005

(65) Prior Publication Data

US 2006/0019560 A1 Jan. 26, 2006

Related U.S. Application Data

(60) Provisional application No. 60/581,904, filed on Jun. 22, 2004.

(51) Int. Cl.
*B63C 9/08* (2006.01)

(52) U.S. Cl. ..... 441/123

(58) Field of Classification Search ..... 441/114–118, 441/123

See application file for complete search history.

(56) References Cited

U.S. PATENT DOCUMENTS 5,111,818 A * 5/1992 Suzuki et al. ..... 600/390
5,338,239 A * 8/1994 Cleaveland ..... 441/106
5,708,978 A * 1/1998 Johnsrud ..... 2/102
5,759,076 A * 6/1998 Bateman et al. ..... 441/115
5,884,198 A * 3/1999 Kese et al. ..... 455/575.6
5,954,556 A 9/1999 Powers
6,546,560 B1 * 4/2003 Fusco et al. ..... 2/67
2002/0182950 A1 12/2002 Foss

FOREIGN PATENT DOCUMENTS

DE 10025976 12/2001
WO WO-01/28486 A1 4/2001

OTHER PUBLICATIONS

"International Search Report for corresponding PCT Application No. PCT/US2005/022134", (Oct. 11, 2005),4 pgs.

* cited by examiner

*Primary Examiner*—Stephen Avila
(74) *Attorney, Agent, or Firm*—Schwegman, Lundberg, Woessner & Kluth, P.A.

(57) ABSTRACT

A personal flotation apparatus including an inflatable bladder assembly coupled along a sleeve. The inflatable bladder assembly includes an inflatable bladder extending at least part way along the sleeve and a gas canister coupled with the inflatable bladder. The inflatable bladder assembly further includes an opening mechanism sized and shaped to open the gas canister. A heart monitor is in communication with the opening mechanism. In one option, the opening mechanism is adapted to open the gas canister and inflate the inflatable bladder when the heart monitor detects a heart rate outside of a predetermined range.

33 Claims, 8 Drawing Sheets

PERSONAL FLOTATION DEVICE AND METHOD FOR SAME

RELATED APPLICATION

This application claims the benefit of U.S. Provisional Patent Application Ser. No. 60/581,904 filed Jun. 22, 2004, which is incorporated herein by reference.

TECHNICAL FIELD

Personal flotation devices and in particular automatically inflatable personal flotation devices.

BACKGROUND

Personal flotation devices are often bulky articles worn around a person's abdomen. Such devices are often cumbersome and hinder free movement of the head and limbs, for example the arms. Children and the elderly often do not recognize the hazards of playing and swimming in water and remove personal flotation devices to more freely move. Personal flotation devices, for example, water wings, life jackets, and the like, are easily removable. Water wings are slid off the arms and life jackets can be unbuckled or the snap fittings disengaged. In some instances, parents do not or cannot pay attention to children that have shed flotation devices. Without the personal flotation device the child is in greater danger of drowning. Children, especially younger children may have little instruction in swimming and do not have the endurance for extended play in deeper water. Further, in some instances, personal flotation devices, even if worn, do not have means for alerting a parent that a child is in distress.

Additionally, skiers, personal watercraft operators and passengers, rescue personnel, dock workers, and the like often do not wear personal flotation devices. High speed water sports like skiing, jet skiing or power boating can cause injuries that result in unconsciousness, or an inability to swim in the case of a broken bone or back. Further, swimmers in rough or rocky water or who are fatigued are often prone to drowning. Cramps cause distress and may result in drowning if a person is unable to swim. Further still, canoeing or rafting in a rocky stream having rough water is hazardous. Canoeists and rafters may tumble from their craft and can strike rocks or get pulled under the water by undertows. Rescue personnel sometimes operate in rough waters or must deal with frantic victims. In some instances, the rescue personnel are pulled under the water by victims or drown in rough water. Often, these individuals do not wear flotation devices because of the encumbrance of the device and/or their perceived confidence of safety in the water. Additionally, where an individual is unconscious, there is often no sign the person is in distress. Life jackets, and other personal flotation devices usually have no means for alerting others of the wearer's distress. Moreover, individuals, in some instances, do not like wearing personal flotation devices because of peer pressure, the perceived unattractiveness of the device, or other aesthetic concerns.

Elderly that enjoy swimming or other water activities often do not wear personal flotation devices. In rough waters, during physically taxing swims, or due to health complications (cardiac arrest, cramps, etc.) elderly individuals become susceptible to drowning. In some instances, they do not like wearing personal flotation devices because of the encumbrance or a perceived sense of confidence of their capabilities in the water.

In an industrial setting, where workers deal with large vats of liquids (paints, chemicals, etc.) there is a risk of falling into the vats and drowning. In some instances, workers do not wear personal flotation devices because of the perceived encumbrance of the device or confidence that they will not fall in.

In many instances, a drowning individual engages in frantic behavior, including thrashing in the water, pulling others under, and the like. This frantic behavior causes an increased heart rate in the drowning person. As the drowning condition progresses to unconsciousness the drowning person experiences a decrease in heart rate as the body is depleted of oxygen.

What is needed is a personal flotation device that is comfortable and non-encumbering for the wearer. What is further needed is a personal flotation device that provides buoyancy when an individual is drowning. What is additionally needed is a personal flotation device that signals others when an individual is in distress.

DESCRIPTION OF THE EXAMPLES

In the following detailed description, reference is made to the accompanying drawings which form a part hereof, and in which is shown by way of illustration specific examples in which the invention may be practiced. These examples are described in sufficient detail to enable those skilled in the art to practice the invention, and it is to be understood that other examples may be utilized and that structural changes may be made without departing from the scope of the present invention. Therefore, the following detailed description is not to be taken in a limiting sense, and the scope of the present invention is defined by the appended claims and their equivalents.

Figure 1:
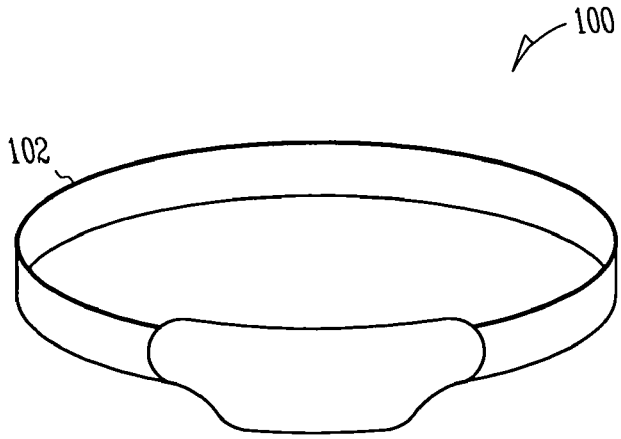
FIG. 1 is a perspective view illustrating a personal flotation device constructed in accordance with one example.

FIG. 1 illustrates an example of a personal flotation assembly 100. In this example, the personal flotation assembly 100 includes a sleeve 102. In one example, the sleeve 102 is dimensioned and configured to fit around a person's neck. In another example, the sleeve 102 is dimensioned and configured to fit around a pet's neck, for instance a dog. In another option, the sleeve 102 is sized to fit around an abdomen or other body part, for example across the chest and around the back. Optionally, the sleeve 102 is adjustable for a variety of neck sizes. In another option, the sleeve 102 has a fixed size. In yet another option, the sleeve 102 should fit snugly around the body, but not be constricting.

Figure 2A:
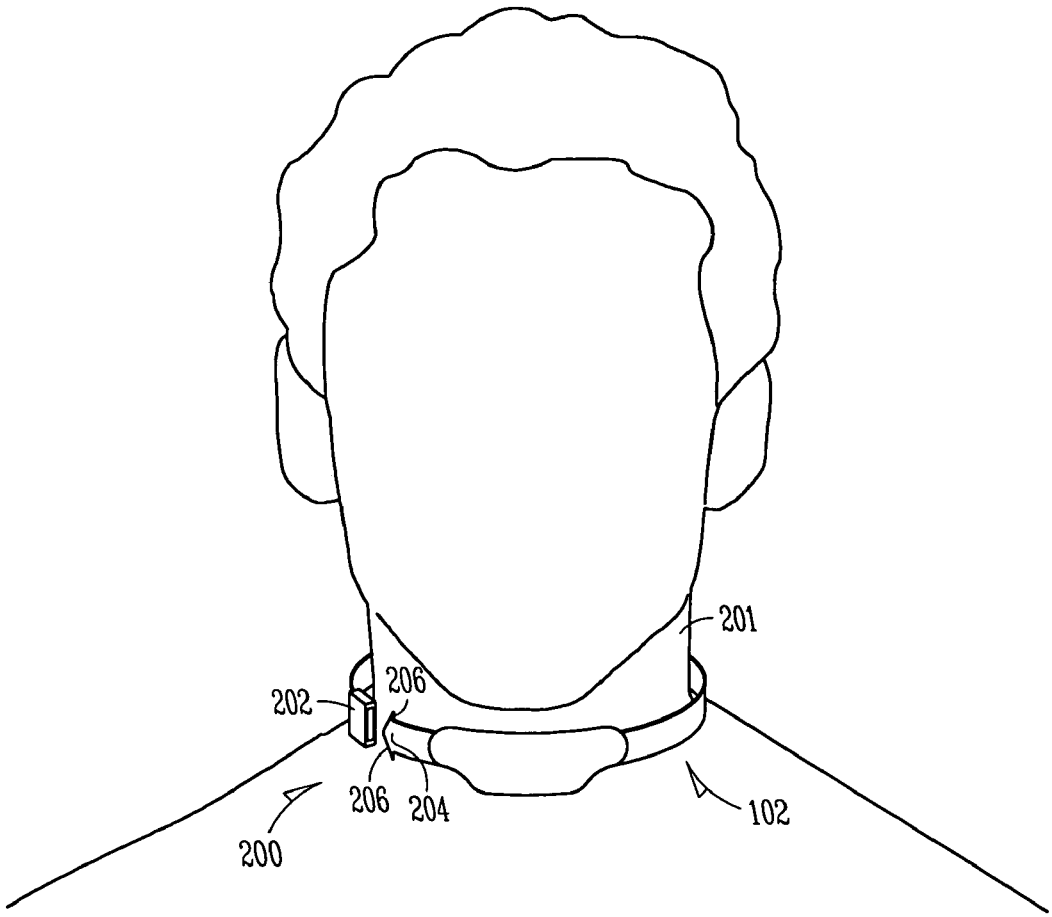
FIG. 2A is a perspective view illustrating a personal flotation device in the process of being placed around a neck in accordance with one example.

FIG. 2A shows one example of the sleeve 102 in an intermediate orientation as it is placed around the neck 201. In one example, opposing ends of the sleeve 102 are joined with fastener 200. In the example shown in FIG. 2A, the fasteners 200 include a female receptacle 202 coupled to one end of the sleeve 102, and a male tab 204 dimensioned and configured to snugly fit with the female receptacle 202. In one example, the male tab 204 includes flange portions 206 that engage the female receptacle during insertion, deform and snap out of the female receptacle to couple the opposing ends of the sleeve 102 together. Other fasteners 200, for example, buttons, hook and loop material, straps and buckles, or the like would also work to couple the opposing ends of the sleeve 102 together.

Figure 2B:
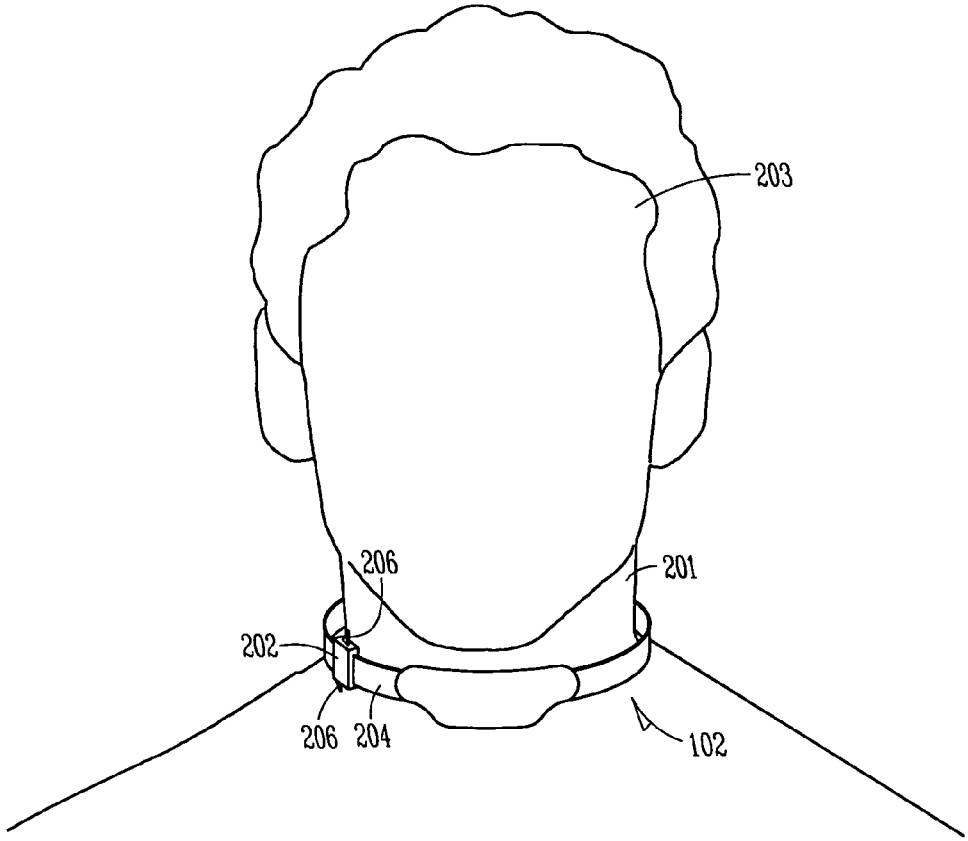
FIG. 2B is a perspective view illustrating a personal flotation device disposed around a person's neck in accordance with one example.

FIG. 2B shows one example of the sleeve 102 disposed around the neck 201. In this example, the male tab 204 is disposed within the female receptacle 202 and the flange portions 206 are snapped out of the female receptacle to couple the opposing ends of the sleeve 102. Thus, the flotation assembly 100 is positioned for inflation and operable to float at least the head 203 above the water. In another example, as described above, the sleeve 102 is dimensioned and configured for positioning on various other portions of the body. In yet another example, multiple sleeves 102 are used to multiply the buoyancy provided to the body.

Figure 2C:
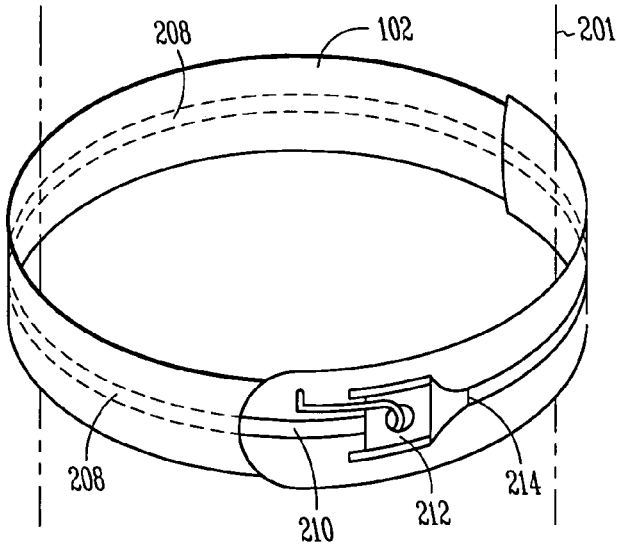
FIG. 2C is a perspective view illustrating a personal flotation device disposed around a person's neck in accordance with another example.

FIG. 2C shows another example of the sleeve 102 disposed around the neck 201. A wire 208 or the like extends at least partially around the sleeve 102. The wire 208, in one example, extends fully around the sleeve 102 and is coupled at both ends by, for instance, a hooked portion 210 of the wire 208 disposed within a looped portion 212. In another example, the wire 208 includes a weakened area 214 along the wire 208. The weakened area 214 has a smaller diameter, is scored, partially cut and the like and is dimensioned and configured to break when sufficient force is applied to the sleeve 102. Breaking of the wire 208 allows for removal of the sleeve 102 in an emergency situation, for instance where the sleeve 102 snags onto the rigging of a boat, to prevent asphyxiation or neck injuries to the wearer. With sufficient pressure, the wearer or another individual can easily remove the sleeve 102 by breaking the wire 208 at the weakened area 214. In yet another example, the wire 208 is broken when the sleeve 102 is snagged and pulled with sufficient force (e.g., by the rigging of a boat, ski line and the like).

Figure 3A:
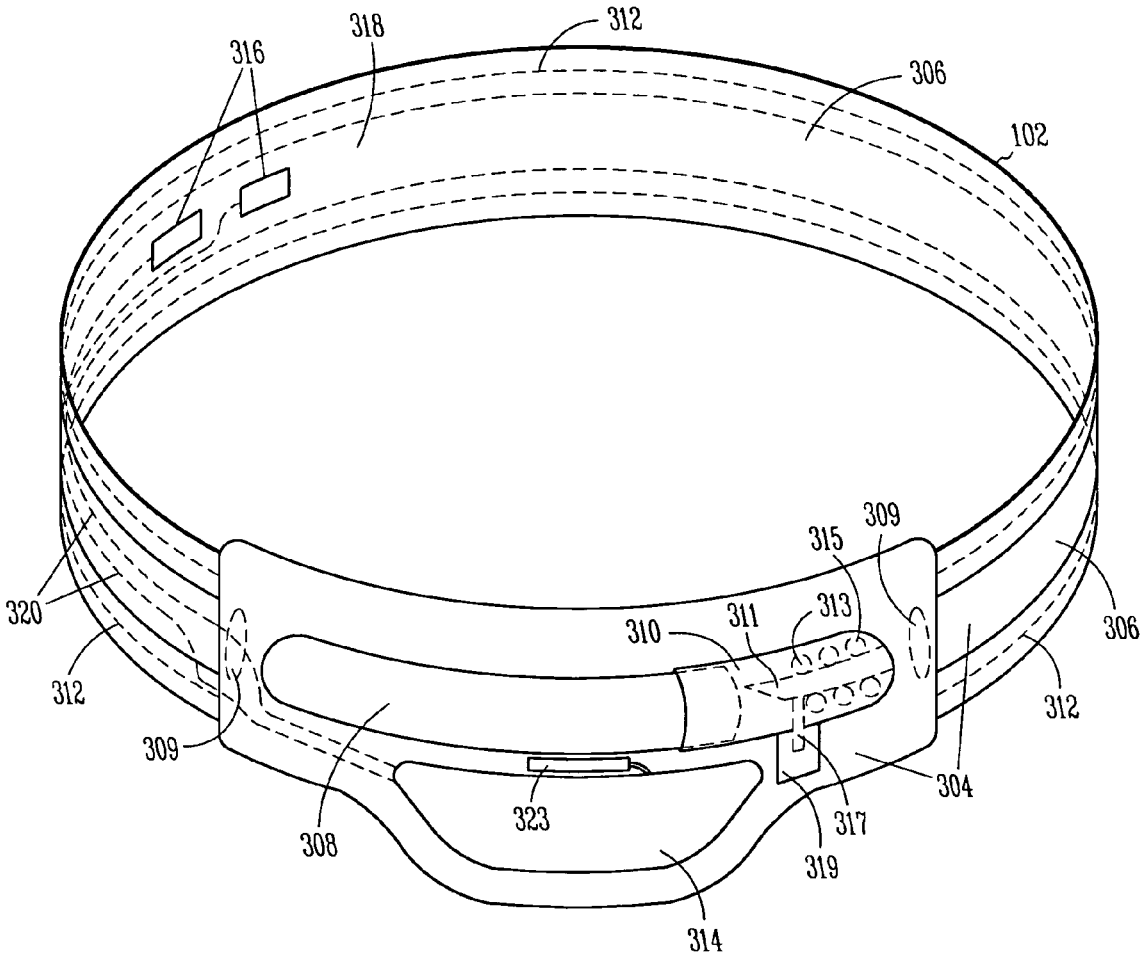
FIG. 3A is a perspective view of an inflatable bladder assembly constructed in accordance with one example.

FIG. 3A illustrates one example of the inflatable bladder assembly 304. In one example, an inflatable bladder assembly 304 is coupled to the sleeve 102. In an example, the inflatable bladder assembly 304 includes an inflatable bladder 306, a gas canister 308 coupled to the inflatable bladder 306, and an opening mechanism 310 coupled to the gas canister. In one option, the inflatable bladder 306 extends around only a portion of the sleeve 102, for example a side and back portion of the sleeve 102 relative to a wearer's throat. In another option, the inflatable bladder 306 extends substantially around the sleeve 102. The gas canister 308 is in fluid communication with the inflatable bladder 306, in one example, through orifices 309. In an example, the gas canister 308 is filled with pressurized air. In another example, the gas canister 308 is filled with a single gas, for example carbon dioxide, or a mixture of gases.

The opening mechanism 310, in one example, includes a needle 311 and a driving mechanism 313 coupled thereto (e.g., a spring and pin, elastomeric material, hydraulic piston, electric actuator, magnetic actuator and the like). For instance, the opening mechanism 313 includes, in an example, a biasing device such as a spring 315 and a pin 317. The pin 317 maintains the spring in a biased position (e.g., compressed or tensioned) until the pin is removed. The pin 317 is moved, for instance, by an actuator 319 such as a solenoid or electrical or magnetic actuator. The driving mechanism, for instance the spring 315, is operable to press the needle 311 into engagement with the gas canister 308 and puncture the canister 308. Puncturing of the gas canister 308 puts the canister 308 in communication with the inflatable bladder 306 and allows the gas to exit and fill the inflatable bladder 306. The needle 311, in another example, includes a lumen therein to facilitate movement of the gas in the canister 308 through the needle 311 and to the inflatable bladder 306.

In another example, the opening mechanism 310 includes a plug disposed within a nozzle of the gas canister 308. In one example, the plug is coupled to an actuating mechanism operable to pull the plug out of engagement with the gas canister 308. Removal of the plug allows gas from the gas canister 308 to flood the inflatable bladder 306. Other mechanisms, for example heating a meltable diaphragm disposed on the gas canister 308, would also work to fill the inflatable bladder 306. In one option, the driving mechanism coupled to the needle and the actuating mechanism coupled to the plug are hydraulic systems that are operated by a solenoid valve. In another option, the mechanism is driven by at least one electrical actuator, magnetic actuator and the like.

Figure 3B:
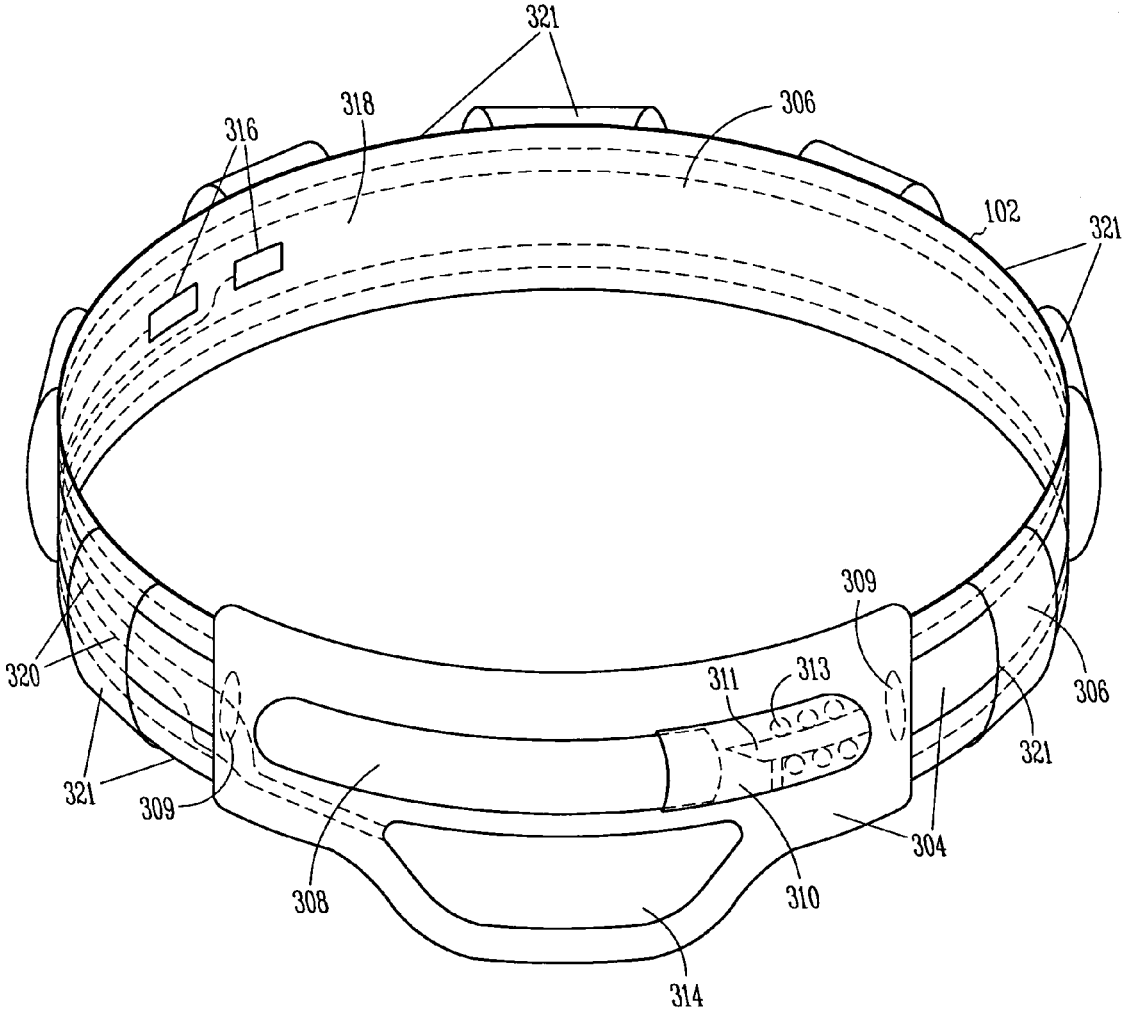
FIG. 3B is a perspective view of an inflatable bladder assembly constructed in accordance with another example.

In the example shown in FIG. 3A, the sleeve 102 includes a substantially rigid core 312 disposed along an interior face of the inflatable bladder 306. The rigid core 312 is constructed to substantially prevent inflation of the inflatable bladder 306 from forcing constriction of the sleeve 102. In other words, the core 312 substantially prevents the inflatable bladder 306 from inflating inwards toward the body around which the sleeve 102 is disposed. In one example, the core 312 includes a metal, for example stainless steel. In another example, the core 312 includes a durable plastic, such as polyvinyl chloride or the like. In yet another example, the core 312 is a composite structure, including for instance a metal substrate with a molded deformable outer sheath of foamed rubber. Optionally, the rigid core 312 and sleeve 102 are integral. The sleeve 102 is thus rigid to substantially prevent constriction of the sleeve 102 and the wearer during inflation of the inflatable bladder 306. In another option, shown in FIG. 3B, the sleeve 102 includes a substantially rigid cage 321. In one example, the cage 321 is coupled to the outer perimeter of the sleeve 102 and at least the inflatable bladder 306 is disposed within the cage 321. In an example, the cage 321 is constructed with materials similar to those of the core 312, for instance stainless steel. The cage 321 includes an interwoven metal tube, in another example, that is surrounded by a deformable outer sheath of foamed rubber. The cage 321 is constructed around the inflatable bladder 306 to substantially prevent inward inflation and thus constriction of the sleeve 102 around the person wearing the sleeve 102.

The flotation assembly 100, shown in FIGS. 3A, B includes a heart monitor 314. In one example, the heart monitor 314 is coupled to the sleeve 102. In another example, the heart monitor 314 is disposed within an elastic band and is electrically coupled to the opening mechanism 310. The elastic band is deformable and allows placement of the heart monitor 314 around the wrist, abdomen, ankle or the like. In yet another example, the heart monitor 314 is compact and positionable within an article of clothing, for instance in a pocket or within a swimming suit. In still another example, the heart monitor 314 is disposed within an adhesive patch and is couplable with the wearer's skin. In the example shown in FIG. 1, the heart monitor 314 is coupled to the sleeve 102 and includes electrodes (i.e. contact pads) 316 disposed along an inner surface 318 of the sleeve 102. The electrodes 316 are in electrical communication with the heart monitor 314, in one example, with wires 320, and operable to detect the heart activity of the wearer.

In one example, the heart monitor 314 detects heart beats per minute. In another example, the heart monitor 314 detects blood pressure. In still another example, the heart monitor 314 detects a range of activities, for example beats per minute and blood pressure. In one example, the heart monitor 314 sends a signal to the opening mechanism 310 to open the gas canister 308 when the heart rate is outside of a predetermined range. For instance, electrical contact with the opening mechanism 310 is cut to allow opening of the gas canister when the heart rate is outside the predetermined range. The heart monitor 314, in another example, must be activated first (e.g. automatically after donning the personal flotation assembly or manually activated) for the opening mechanism 310 to automatically open the gas canister 308 when the proscribed condition is met (e.g., when the wearer's heart rate is outside of a predetermined range). For maintenance purposes in one option, if a battery goes dead or there is a malfunction in the personal flotation assembly 100 the gas canister 308 opens and inflates the inflatable bladder 306 as a notice to repair the assembly 100 or at least replace a battery, in yet another example.

Optionally, the personal flotation assembly 100 includes a liquid sensor 323 coupled to at least one of the opening mechanism 310 and the heart monitor 314. The liquid sensor 323 operates to prevent inflation of the inflatable bladder 306 (described herein) unless the personal flotation assembly 100 is in a liquid such as water. In one option, the heart monitor 314 includes a computer readable medium (e.g., microchip, hard disc, floppy disk, memory and the like) adapted to contain the predetermined range of heart rates. In another option, the heart monitor 314 is in communication with another device, for instance, a separate base unit (e.g., cellular phone, personal data assistant, dedicated device, network, satellite, and the like) that contains the predetermined range of heart rates. The heart monitor 314, in yet another option, is preprogrammed with the range of heart rates. Optionally, the predetermined range is set after purchase or provision of the device by the end user, a parent, a physician, or the like. In one example, the predetermined range of heart rates for a child is between around 60 beats per minute to 200 beats per minute. When the child's heart rate is outside of this predetermined range a signal is sent to the opening mechanism 310 to open the gas canister 308 and inflate the inflatable bladder 306. In another example, the child's heart rate is a different predetermined range, for instance with lower or higher upper and lower boundaries. In yet another example, the predetermined range of heart rates for an elderly person is 30 beats per minute to 130 beats per minute. In still another example, the predetermined range of heart rates for an adult is 30 beats per minute to 190 beats per minute. Optionally, the predetermined ranges of heart rates would vary outside of these examples, for instance, between approximately at least 20 and 220 beats per minute. Moreover, where the flotation assembly 100 is used with animals, for example pets, the predetermined range would be set according to the type of pet and/or the pet's age. The lower range of the heart rates corresponds to a drowning condition, where the body experiences oxygen deprivation and heart activity decreases or ceases. The higher range of the heart rates corresponds to a panicking condition, when the wearer fears for his safety. In one example, the wearer may fear for his safety when beginning to drown.

The flotation assembly 100, in one example, would come with preset values for the predetermined range. In other words, the flotation assembly 100 has preset values when purchased. In another example, the sleeve 102 is sized for a particular size of neck. In yet another example, the flotation assembly 100 includes a sleeve 102 presized for a particular neck size, the inflatable bladder assembly 304 is preset to inflate and float a particular weight, and the heart monitor 314 includes a preset predetermined range of heart rates for triggering the opening mechanism 310. Optionally, the flotation assembly 100 could come with any of these options preset while others are adjustable. In one option, the inflatable bladder assembly 304 is preset to inflate and float at least a weight corresponding to a wearer's head so the head remains above the water.

Figure 3C:
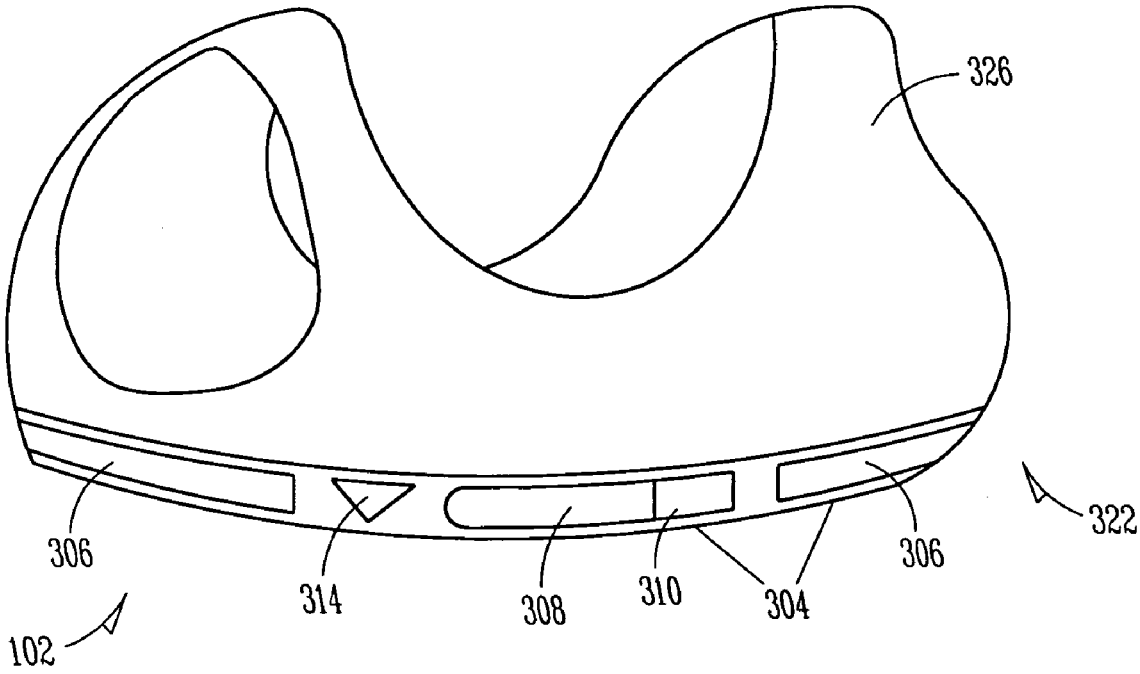
FIG. 3C is a perspective view of an inflatable bladder assembly constructed in accordance with yet another example.
Figure 3D:
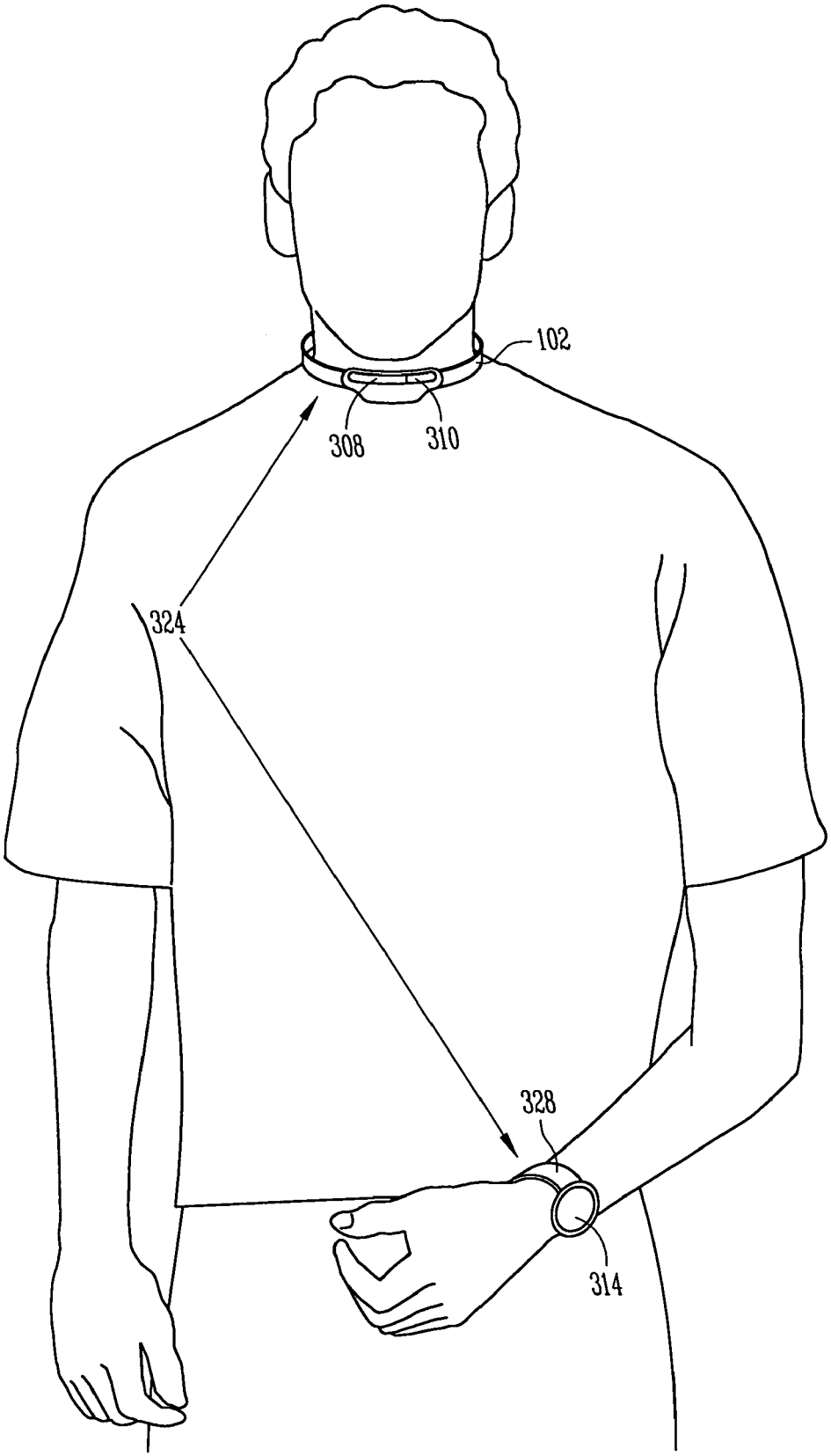
FIG. 3D is a perspective view of an inflatable bladder assembly constructed in accordance with one example including a detached heart monitor.

FIGS. 3C and 3D illustrate additional examples of flotation assemblies 322, 324. The examples of flotation assemblies 322, 324 are similar in some respects to the flotation assembly 100. Flotation assembly 322 (FIG. 3C) includes a sleeve 102 coupled with an article of swimwear such as a swim suit 326. The sleeve 102 extends at least part way around the abdomen, chest, waist or the like of the wearer. The inflatable bladder 306 is coupled to the sleeve 102 and, in one example, is also coupled with the swim suit 326. The opening mechanism 310 is coupled to a gas canister 308. As described above, the opening mechanism 310 includes, but is not limited to, a needle, and the opening mechanism 310 is operable to open the gas canister 308 to inflate the inflatable bladder 306. A heart monitor 314 is coupled to the sleeve and electrically coupled to the opening mechanism 310, in another example.

In yet another example, the flotation assembly 324 shown in FIG. 3D includes a sleeve 102 dimensioned and configured to fit around a person's neck. The flotation assembly 324 includes a gas canister 308 and an opening mechanism 310 coupled with the gas canister 308. The opening mechanism 310 is in communication with the heart monitor 314. The heart monitor 314, in the example shown in FIG. 3D, is disposed in an elastic band 328 (e.g. a wrist band). The heart monitor 314 includes a transmitter including, but not limited to a radio transmitter. Optionally, the heart monitor 314 is electrically coupled to the opening mechanism 310 with flexible wiring for example. The heart monitor 314 transmits commands to the opening mechanism 314 including, for instance, a command to open the gas canister 308. The opening mechanism 314, in one example, includes a corresponding receiver. In another example, the sleeve 102 is coupled to an article of swim wear (described above). In yet another example, the sleeve 102 extends around the chest or another part of the body.

Figure 4:
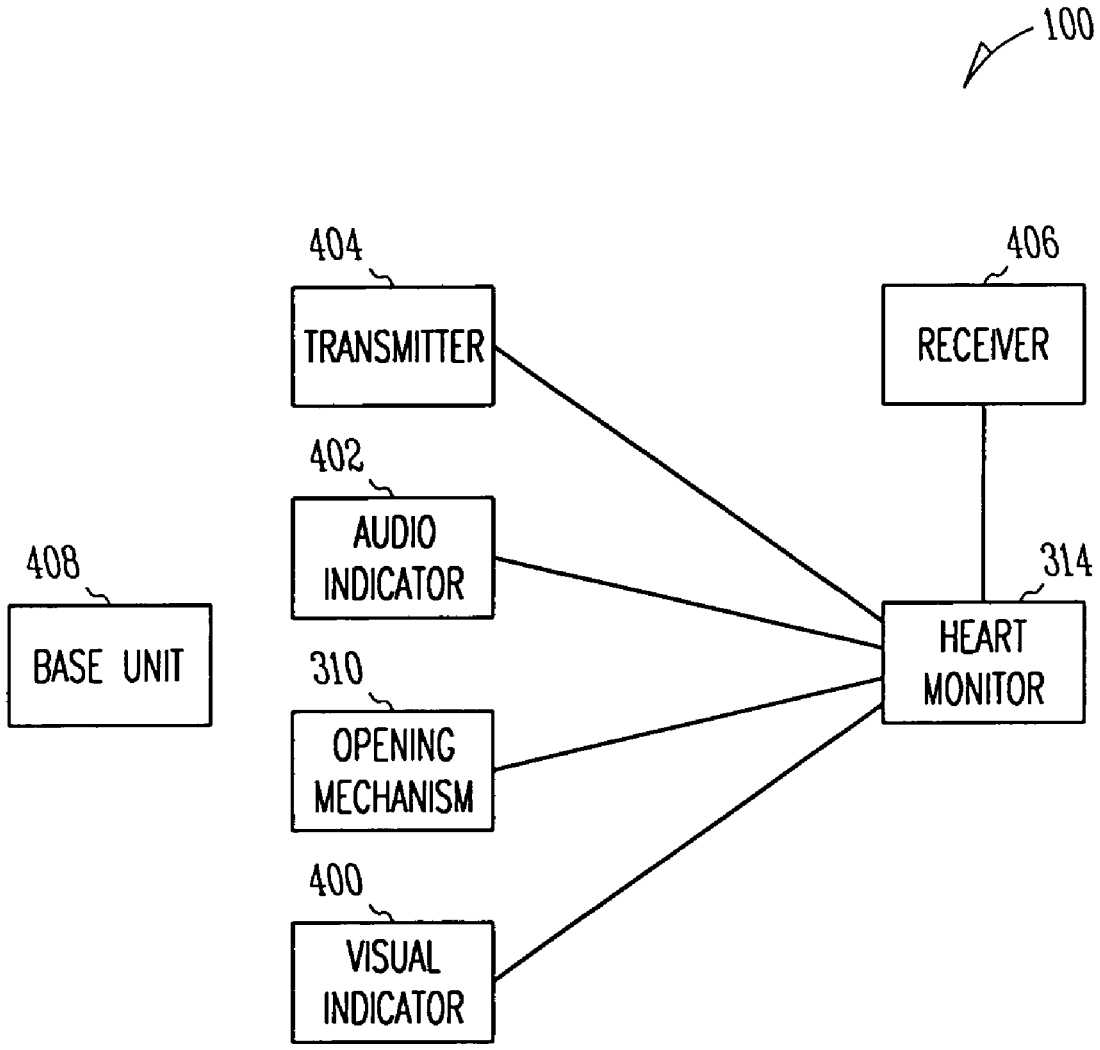
FIG. 4 is a schematic diagram showing a personal flotation device constructed in accordance with one example.

FIG. 4 is a schematic diagram of the flotation assembly 100. The heart monitor 314 is electrically coupled to the opening mechanism 310. As described in one example above, when the heart monitor 314 detects a heart rate of the wearer outside of a predetermined range, the heart monitor sends a signal to the opening mechanism 310. For instance, the heart monitor 314 sends an electrical, radio signal or the like or discontinues sending signals to the opening mechanism 310 (e.g., opens a circuit) to operate the opening mechanism 310. The opening mechanism 310 operates to open the gas canister 308 (see FIGS. 3A–C) and inflate the inflatable bladder 306 coupled thereto.

In one option, the heart monitor 314 is coupled to a visual indicator 400, for instance, a flashing light, dye pack or the like. The heart monitor 314 sends a signal to the visual indicator 400 along with a signal to the opening mechanism 310 when, for example, the heart rate is outside a predetermined range. In another option, the heart monitor 314 is coupled to an audio indicator 402. The audio indicator 402 includes, but is not limited to a loudspeaker, whistle, alarm or the like. The audio indicator 402 sounds when the heart monitor 314 sends a signal to the audio indicator 402 because, for example, the heart rate is outside a predetermined range. The audio indicator 402, in another example, sounds when the flotation assembly 100 moves beyond a predetermined distance from a corresponding base unit carried, for instance by a parent. In still another option, the heart monitor 314 is coupled to a transmitter 404. The transmitter 404 includes, but is not limited to a GPS transmitter, tracking device, or the like. Similar to the audio indicator 402 described above, in another example, the transmitter 404 transmits when the flotation assembly 100 moves beyond a predetermined distance from a corresponding base unit 408 (e.g., dedicated unit, cellular phone, computer and the like). In yet another example, the transmitter 404 transmits when the heart monitor 314 detects a heart rate outside of a predetermined range. Optionally, the personal flotation assembly includes a receiver 406 coupled with the opening mechanism 310. The receiver 406 operates to receive commands that remotely activate the opening mechanism 310 and thereby inflate the inflatable bladder 306. In still another option, the receiver 406 receives commands that remotely operate the audio indicator 402, visual indicator 400 and the like.

Figure 5:
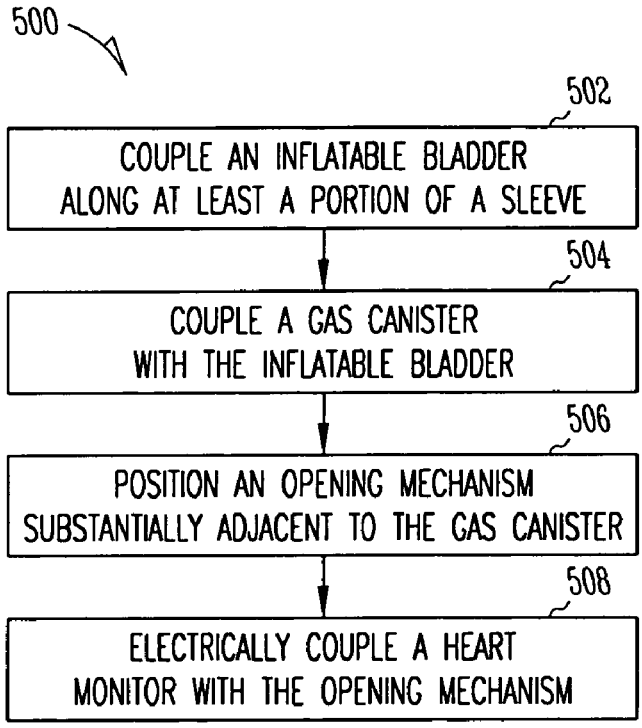
FIG. 5 is a block diagram illustrating a method of constructing a personal flotation device in accordance with one example.

FIG. 5 is a block diagram illustrating one example of a method 500 for constructing a personal flotation device, for example the personal flotation assembly 100 shown in FIGS. 3A, B. At 502 an inflatable bladder 306 is coupled along at least a portion of a sleeve 102. In one example, the sleeve is dimensioned and configured to fit around a person's neck. The sleeve is dimensioned and configured to fit around the chest, abdomen, arms or the like, in another example. At 504, a gas canister 308 is coupled with the inflatable bladder 306. At 506, an opening mechanism 310 is positioned substantially adjacent to the gas canister 308. In another example, the opening mechanism 310 includes a needle mechanism having a needle 311 and a driving mechanism 313 (e.g., biasing device such as a spring, hydraulic piston, actuator and the like) to move the needle. In yet another example, the opening mechanism 310 includes a plugging mechanism having a plug and an actuation mechanism to remove the plug from engagement with the gas canister. In still another example, the opening mechanism 310 includes a meltable diaphragm adapted to melt and open the gas canister 308. At 508, a heart monitor 314 is electrically coupled with the opening mechanism 310. The heart monitor 314 is coupled, in one example, to an elastic band, an adhesive patch, a swimsuit, or the like, as described above. In still another example, the heart monitor 314 includes electrodes 316 disposed along an inner surface of the sleeve 102. The electrodes 316 (e.g., contact pads) are operable for sensing, for example, the heart rate of a wearer. In another example, the heart monitor 314 and opening mechanism 310 are coupled with transmitters that send signals between the heart monitor and the opening mechanism 310. Optionally, the heart monitor 314 and opening mechanism 310 are operable to send signals back and forth between the two devices. In another option, the heart monitor 314 also acts as a tracking device and is operable to send signals to a separate third device, for example a position locator.

Various options for making the personal flotation assembly 100 follow. In one option, the method 500 includes coupling at least one of a visual indicator and an audio indicator with the heart monitor (e.g., light, dye pack, loudspeaker and the like). In another option, at least one of a transmitter and a receiver is coupled with the heart monitor. The transmitter and receiver optionally communicate with a third device, such as, a dedicated base unit, cellular phone, personal data assistant, computer, satellite and the like. In one example, the transmitter is a radio transmitter. In another example, the transmitter is a global positioning system transmitter. The transmitter operates, in still another example, when the heart monitor 314 detects a heart rate outside of a predetermined range. The transmitter operates on a preset interval, in another example. In still another example, the transmitter operates continuously. In yet another option, coupling the inflatable bladder along at least the portion of the sleeve 102 includes coupling the inflatable bladder 306 around a back and side portions of the sleeve 102 relative to the heart monitor 314.

In another option, positioning the opening mechanism 310 substantially adjacent to the gas canister 308 includes coupling the opening mechanism 310 with the gas canister 308. The opening mechanism 310 optionally includes a drive mechanism 313 (e.g., spring, elastomeric material, actuator and the like) and a needle 311. In yet another option, positioning the opening mechanism 310 substantially adjacent to the gas canister 308 includes coupling the opening mechanism with the sleeve 102. The method 500 includes, optionally, coupling an actuator, such as, a solenoid valve 319 with a moveable pin 317. The pin 317 is engaged with a drive mechanism 313 to retain the drive mechanism 313 in a first biased position. In an option, the method 500 further includes screwing the gas canister 308 into the inflatable bladder assembly 304.

Figure 6:
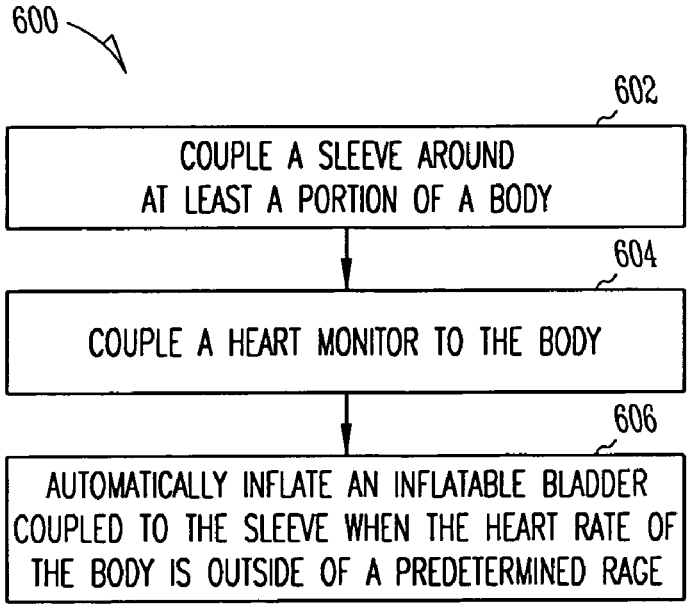
FIG. 6 is a block diagram illustrating a method of using a personal flotation device in accordance with one example.

FIG. 6 is a block diagram illustrating one example of a method 600 for using a personal flotation assembly 100. Reference is again made to the personal flotation assembly 100 shown in FIGS. 3A, B. At 602, a sleeve 102 is coupled around at least a portion of a body (e.g., a child). In one example, coupling the sleeve 102 includes snugly coupling the sleeve 102 around the neck of the body. In another example, snugly coupling the sleeve 102 includes snap-fitting a male projection with a female receptacle (e.g., flange portions 206 and female receptacle 202) on the sleeve 102. At 604, a heart monitor 314 is coupled to the body. In one example, the heart monitor 314 is coupled to the sleeve 102. In another example, the heart monitor 314 is disposed within an adhesive patch, a swimsuit, an elastic band, or the like. In still another example, the heart monitor 314 includes electrodes 316 that are engaged to the skin of the wearer. The heart monitor 314 is operable to detect at least one heart condition of the wearer, for example, a heart rate. At 606, the inflatable bladder 306 coupled to the sleeve 102 is automatically inflated when the heart rate of the body is outside of a predetermined range.

Several options for the method 600 follow. In one option, automatically inflating the inflatable bladder 306 includes puncturing a gas canister 308 coupled to the inflatable bladder 306. In another option, automatically inflating the inflatable bladder 306 includes operating an actuator (e.g., opening mechanism 310) coupled with the heart monitor 314. Operating the actuator includes, in yet another option, moving a pin 317 out of engagement with a drive mechanism 313 adapted to puncture a gas canister 308 with a needle 311. The drive mechanism 313 includes, but is not limited to, a biasing device such as a spring or elastomeric material, electric or magnetic actuators (e.g., solenoids), and the like. In still another option, automatically inflating the inflatable bladder 306 includes pulling a plug out of the gas canister, heating a meltable diaphragm and the like. Optionally, automatically inflating the inflatable bladder 306 includes constraining the bladder 306 to inflate substantially outward from the sleeve 102, for instance, with a rigid core 312, cage 321 and the like. In one example, a rigid core 312, cage 321 and the like are used to constrain inflation of the bladder 306.

In another option, the method 600 includes automatically inflating the bladder 306 when the heart rate of the body is outside of a range of, for instance, approximately 30 beats per minute to 190 beats per minute. The inflatable bladder 306 automatically inflates when the heart rate of the body is outside of a predetermined range and the sleeve 102 is in contact with a liquid, optionally. In yet another option, the method 600 includes operating at least one of a visual indicator and an audio indicator when the heart rate of the body is outside of the predetermined range. The inflatable bladder 306 automatically inflates and is sufficiently buoyant to float at least the head of the body above a liquid, in still another option. In a further option, the method 600 includes sending a signal from a transmitter coupled with the heart monitor to a separate device, such as, a dedicated receiver, cellular phone, computer, personal data assistant, satellite and the like.

The above describe personal flotation assembly provides buoyancy at least when a wearer's heart condition is outside of a predetermined range, for example, the when the wearer's heart rate is outside of range of heart rates such as when the wearer is drowning. The personal flotation assembly inflates and keeps at least the head of the wearer above water to facilitate continued breathing and preclude drowning. The personal flotation assembly combines the inflatable bladder assembly, opening mechanism and the heart monitor into a compact design sized and shaped to be comfortably worn without unduly interfering with the activity of the wearer. For instance, the personal flotation assembly, is lightweight and sized and shaped to allow the wearer to substantially maintain a full range of motion when wearing the assembly. Additionally, the personal flotation assembly, in one option, is made integral with a piece of swimwear thereby making the assembly attractive.

The conditions used to determine when the inflatable bladder of the personal flotation assembly is inflated, in one example, are preprogrammed for each personal flotation assembly. In another example, the conditions are programmed after purchase by the wearer, physician, family member and the like. The conditions that trigger inflation optionally include a wide variety of stimuli alone or in combination. For example, conditions such as a heart rate outside of a predetermined range, blood pressure, immersion of the sleeve in liquid, the location of the personal flotation assembly with respect to a base unit, remaining charge of a power source such as a battery and the like operate alone or in combination to cause inflation of the personal flotation assembly. These conditions for activation may be adjusted or eliminated depending on the use of the assembly, the age of the wearer, the wearer's physical condition and the like. The personal flotation assembly inflates the inflatable bladder when the set of conditions are satisfied and the bladder operates to maintain at least the head of a wearer above water.

Further, the personal flotation assembly includes in another option, at least one indicator adapted to provide an alert when the inflatable bladder is inflated. In one example, the indicator includes, but is not limited to a visual indicator, such as a light, dye pack and the like. In another example, the indicator includes an audio indicator, such as a loud speaker. In still another example, the personal flotation assembly includes a transmitter or the like sized and shaped to transmit an alert that the inflatable bladder has inflated to a base unit (e.g., the base unit is with a parent and the assembly is with a child, and the assembly thereby alerts the parent to a child in distress).

It is to be understood that the above description is intended to be illustrative, and not restrictive. Many other examples will be apparent to those of skill in the art upon reading and understanding the above description. It should be noted that examples discussed in different portions of the description or referred to in different drawings can be combined to form additional examples of the present application. The scope of the invention should, therefore, be determined with reference to the appended claims, along with the full scope of equivalents to which such claims are entitled.

What is claimed is:

1. A personal flotation apparatus comprising:

a sleeve;

an inflatable bladder assembly coupled with the sleeve, wherein the inflatable bladder assembly includes:

an inflatable bladder extending at least part way along the sleeve, a gas canister coupled with the inflatable bladder, an opening mechanism sized and shaped to open the gas canister; and a heart monitor in communication with the opening mechanism.

2. The personal flotation apparatus of claim 1, wherein the sleeve includes a substantially rigid core extending along at least a portion of a length of the sleeve, and the substantially rigid core is disposed along at least an interior face of the inflatable bladder.

3. The personal flotation apparatus of claim 1, wherein a substantially rigid cage surrounds at least a portion of the inflatable bladder.

4. The personal flotation apparatus of claim 1, wherein the heart monitor includes an adjustable band.

5. The personal flotation apparatus of claim 4, wherein the adjustable band is dimensioned and configured to be disposed around a wrist, ankle, or abdomen.

6. The personal flotation apparatus of claim 1, further comprising a swimsuit, and at least the heart monitor is in the swimsuit.

7. The personal flotation apparatus of claim 1, further comprising at least one of a visual indicator and an audio indicator in communication with the heart monitor.

8. The personal flotation apparatus of claim 1, further comprising at least one of a transmitter and a receiver in communication with the heart monitor.

9. The personal flotation apparatus of claim 1, wherein the heart monitor includes a predetermined range of heart rates.

10. The personal flotation apparatus of claim 9, wherein the heart monitor is programmable to adjust the predetermined range of heart rates.

11. The personal flotation apparatus of claim 1, wherein the opening mechanism includes a moveable needle and a drive mechanism in communication with the heart monitor, and the drive mechanism is adapted to puncture the gas canister with the needle.

12. The personal flotation apparatus of claim 11, wherein the drive mechanism includes a pin adapted to engage with a biasing device, and the pin retains the biasing device in a first biased position.

13. The personal flotation apparatus of claim 1, wherein the inflatable bladder assembly is operable to float at least a weight corresponding to a head above a liquid.

14. A method for making a personal flotation apparatus comprising:

coupling an inflatable bladder along at least a portion of a sleeve;

coupling a gas canister with the inflatable bladder;

positioning an opening mechanism substantially adjacent to the gas canister; and electrically coupling a heart monitor with the opening mechanism.

15. The method for making a personal flotation apparatus of claim 14, further comprising coupling at least one of a visual indicator and an audio indicator with the heart monitor.

16. The method for making a personal flotation apparatus of claim 14, further comprising coupling at least one of a transmitter and a receiver with the heart monitor.

17. The method for making a personal flotation apparatus of claim 14, wherein positioning the opening mechanism substantially adjacent to the gas canister includes coupling the opening mechanism with the gas canister, and the opening mechanism includes a drive mechanism and a needle.

18. The method for making a personal flotation apparatus of claim 14, wherein positioning the opening mechanism substantially adjacent to the gas canister includes coupling the opening mechanism with the sleeve, and the opening mechanism includes a drive mechanism and a needle.

19. The method for making a personal flotation apparatus of claim 14, wherein positioning the opening mechanism substantially adjacent to the gas canister includes coupling a solenoid valve with a moveable pin.

20. The method for making a personal flotation apparatus of claim 19, wherein positioning the opening mechanism substantially adjacent to the gas canister includes engaging the pin with a drive mechanism in a first biased position.

21. A method for making a personal flotation apparatus of claim 14, wherein coupling the inflatable bladder along at least the portion of the sleeve includes coupling the inflatable bladder around a back and side portions of the sleeve relative to the heart monitor.

22. A method for using a personal flotation apparatus comprising:

coupling a sleeve around at least a portion of a body;

coupling a heart monitor to the body; and automatically inflating an inflatable bladder coupled to the sleeve when the heart rate of the body is outside of a predetermined range.

23. The method for using the personal flotation apparatus of claim 22, wherein coupling the sleeve around at least a portion of the body includes snugly coupling the sleeve around a neck.

24. The method for using the personal flotation apparatus of claim 23, wherein snugly coupling the sleeve includes snap-fitting a male projection with a female receptacle on the sleeve.

25. The method for using the personal flotation apparatus of claim 22, wherein automatically inflating the inflatable bladder includes puncturing a gas canister coupled to the inflatable bladder.

26. The method for using the personal flotation apparatus of claim 22, wherein automatically inflating the inflatable bladder includes operating an actuator coupled to the heart monitor.

27. The method for using the personal flotation apparatus of claim 26, wherein operating the actuator includes moving a pin out of engagement with a drive mechanism adapted to puncture a gas canister.

28. The method for using the personal flotation apparatus of claim 22, wherein automatically inflating the inflatable bladder includes inflating the bladder when the heart rate of the body is outside of a range of approximately 30 beats per minute to 190 beats per minute.

29. The method for using the personal flotation apparatus of claim 22, further comprising operating at least one of a visual indicator and an audio indicator when the heart rate of the body is outside of the predetermined range.

30. The method for using the personal flotation apparatus of claim 22, further comprising automatically inflating the inflatable bladder coupled to the sleeve when the heart rate of the body is outside of a predetermined range and the sleeve is in contact with a liquid.

31. The method for using the personal flotation apparatus of claim 22, wherein automatically inflating the inflatable bladder includes constraining the bladder to inflate substantially outward from the sleeve.

32. The method for using the personal flotation apparatus of claim 22, further comprising sending a signal from a transmitter coupled with the heart monitor to a separate device.

33. The method for using the personal flotation apparatus of claim 22, wherein automatically inflating an inflatable bladder includes floating at least the head of the body above a liquid.

* * * * *